US006692314B1

(12) United States Patent
Pares Caselles

(10) Patent No.: US 6,692,314 B1
(45) Date of Patent: Feb. 17, 2004

(54) DEVICE FOR FIXING ELECTRICAL COMPONENTS

(75) Inventor: Josep Maria Pares Caselles, Valls (ES)

(73) Assignee: Lear Automotive (EEDS) Spain, S.L., Tarragona (ES)

( * ) Notice: Subject to any disclaimer, the term of this patent is extended or adjusted under 35 U.S.C. 154(b) by 0 days.

(21) Appl. No.: 10/049,112

(22) PCT Filed: Aug. 10, 2000

(86) PCT No.: PCT/ES00/00320

§ 371 (c)(1),
(2), (4) Date: Jun. 6, 2002

(87) PCT Pub. No.: WO01/11250

PCT Pub. Date: Feb. 15, 2001

(30) Foreign Application Priority Data

Aug. 10, 1999 (ES) ..... 9902150

(51) Int. Cl.[7] ..... H01R 4/30
(52) U.S. Cl. ..... 439/801; 431/521
(58) Field of Search ..... 439/801, 521, 439/431, 883, 754, 755, 567

(56) References Cited

U.S. PATENT DOCUMENTS

| | | | | |
|---|---|---|---|---|
| 3,895,663 A | | 7/1975 | Bashline et al. | |
| 3,944,315 A | | 3/1976 | Hild et al. | |
| 4,543,763 A | | 10/1985 | Ernst et al. | |
| 5,145,421 A | * | 9/1992 | Julian | 439/801 |
| 5,413,500 A | * | 5/1995 | Tanaka | 439/521 |
| 5,628,599 A | | 5/1997 | Eakin | |
| 6,139,362 A | * | 10/2000 | Brown | 439/567 |

FOREIGN PATENT DOCUMENTS

| | | |
|---|---|---|
| DE | 3602295 | 7/1987 |
| DE | 4115002 | 12/1991 |
| EP | 418002 | 3/1991 |

* cited by examiner

*Primary Examiner*—Alexander Gilman
(74) *Attorney, Agent, or Firm*—Sughrue, Mion, PLLC

(57) ABSTRACT

Device for fixing electric components comprising a base element (1), a screw (4) of which the head 6) is connected to said element (4) and hold an electric component (12) inserted therein. The device is also comprised of a retention element (8) inserted in the screw (4) so that when screwing the nut (7) said retention element (8) expands inside the base element (1) thereby blocking the screw (4) with respect to the base element.

7 Claims, 2 Drawing Sheets

DEVICE FOR FIXING ELECTRICAL COMPONENTS

This application is a 371 of PCT/ES00/00320 filed Aug. 10, 2000. The disclosure of which is incorporated herein by reference.

A device for fixing electrical components.

The present Utility Model application, as its title indicates, consists of a "Device for fixing electrical components" whose new characteristics of construction, shape and design fulfill the object for which it has specifically been planned, with maximum safety and effectiveness.

The fixing of electrical components, for example battery terminals, on base elements, such as an electrical circuit board, are normally carried out conventionally by providing a bolt which is potted on said base element, so that both elements are joined and form a single piece. The potting is carried out in such a way that the shaft emerges perpendicularly from the base element and is ready to receive the electrical component in question, which is held by means of a nut threaded on the shaft of the bolt.

Joining the bolt to the base element by using potting techniques are expensive, which negatively affects the cost of the electrical assembly. Therefore, solutions have been proposed, such as making a hole in said base element to pass the shaft of the bolt through its inside, with the head remaining underneath the base element.

The drawback of this type of connection of the bolt with the base element is that the bolt is not usually fixed rigidly in the latter, and the bolt head constitutes an undesirable electrical contact point.

The present invention has been developed in order to resolve all these said drawbacks, providing a device for fixing the electrical components with an advantageous configuration, which allows said electrical components to be fixed safely and at small cost compared to conventional fixing devices.

In general terms, the device for fixing electrical components, which is the object of the present invention, is of the type which comprises, as described above, a base element, a bolt whose head is joined to said base element and a nut threaded on the bolt to hold an electrical component which is inserted in the same, for example a battery terminal.

The peculiarity of the device for fixing electrical components of the invention lies in the fact that it includes, moreover, a holding element which is inserted in the bolt. In this way, when the nut is threaded on the bolt, the holding element expands inside the base element and blocks the bolt with respect to said base element, thus preventing any movement of the latter.

In accordance with an advantageous feature of the fixing device of the invention, the holding element comprises a surface provided with a central orifice, inside which the body of the bolt passes. A number of legs project from said surface, which conveniently couple in housings made in the base element. These legs of the holding element include a series of teeth which serve to ensure that the holding element is fixed in said housings of the base element.

Preferably, the holding element has four legs and the base element has a housing with dimensions which are complementary to those of the bolt head. Said base element also comprises four peripheral housings in which said four legs of the holding element are inserted.

The bolt is thus fixed safely by its head in the base element, since the provision of a holding element, such as that described, makes it difficult to extract the bolt from the base element in the event that a force is applied to the shaft of the bolt. This also has a positive effect in ensuring the effective fixing of the electrical component. It should especially be noted that by means of the device of the present invention, electrical components are effectively fixed in an economical way.

The features and advantages of the device for fixing electrical components of the present invention will be clearer from the detailed description of a preferred embodiment of the same. Said description will be given, from here on, by way of non-restrictive example, with reference to the drawings which accompany it, in which.

The elements which appear in the attached drawings are the following: (1) base element, (2) central housing of the base element, (3) peripheral housings of the base element, (4) bolt, (5) bolt shaft (6) bolt head, (7) nut, (8) holding element, (9) surface of holding element, (10) central orifice of the holding element, (11) legs of the holding element, (12) electrical component, (13) end of the electrical component, (14) orifice of the electrical component and (15) surface of the base element.

Figure 1:
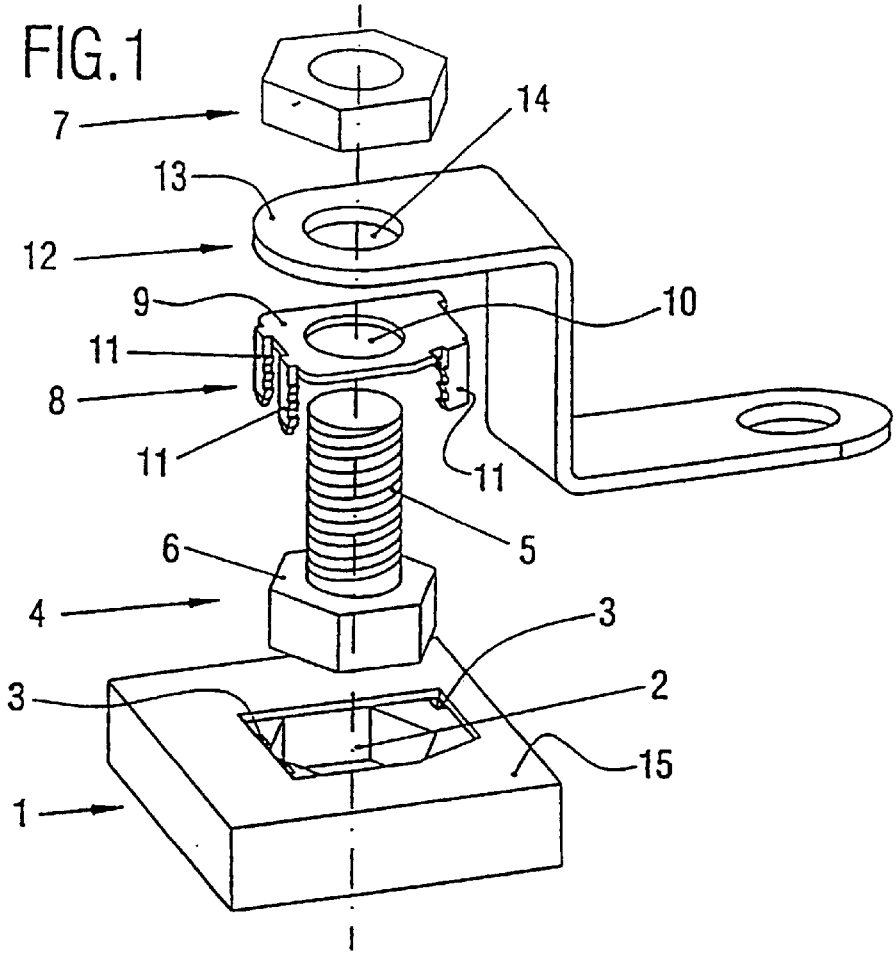
FIG. 1 is an exploded perspective view of a device for fixing electrical components in accordance with the present invention.
Figure 2:
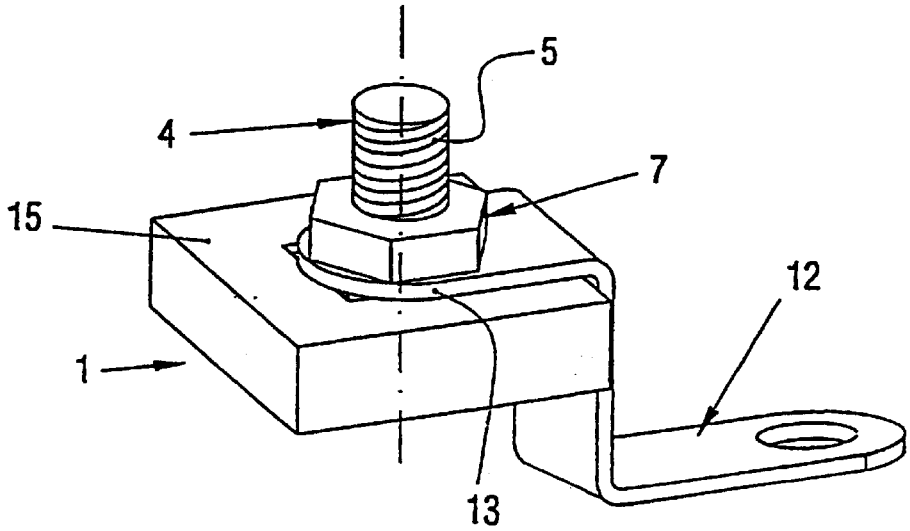
FIG. 2 is a perspective view of the device of the invention in which all the elements which make it up are shown mounted.
Figure 3:
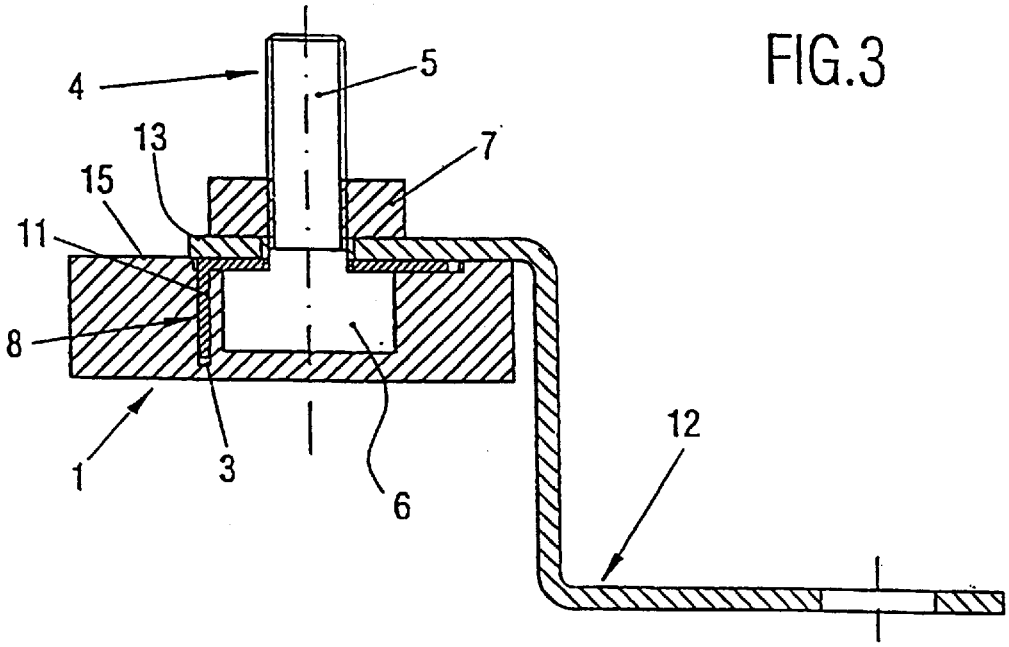
FIG. 3 is an elevation view in which a cross-section of the device of the invention is represented through the plane AA of FIG. 4.
Figure 4:
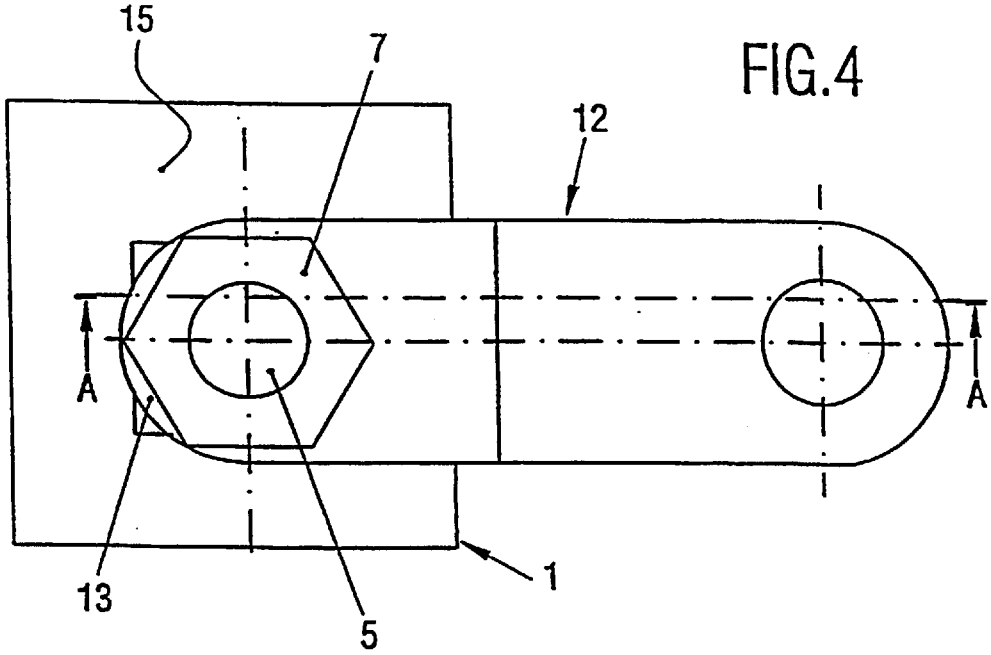
FIG. 4 is a plan view of the device of the present invention.

The device for fixing electrical components of the invention comprises a base element (1) which includes a central housing (2) and four peripheral housings (3). The device is also made up of a bolt (4) comprising a shaft (5) and a head (6). As may be observed in FIGS. 2 and 3, the head (6) of the bolt (4) is joined to the base element (1) and situated inside the central housing (2) which, as shown in FIG. 1, has a shape and dimensions that are complementary to those of the head (6) of the bolt (4) to prevent the bolt (4) from turning with respect to said base element (1).

A nut (7) is also provided, which threads onto the shaft (5) of the bolt (4) and there is a holding element (8) comprising a surface (9) provided with a central orifice (10) inside which the shaft (5) of the bolt (4) passes. As may be observed, four toothed legs (11) project from the surface (10) of said holding element (8), which conveniently couple in the peripheral housings (3) of the base element (1).

The reference number (12) designates the electrical component to be fixed, which may have any known shape, for example a car battery terminal. The electrical component (12) represented in the drawings is inserted by its end (13) onto the shaft (5) of the bolt (4) thanks to an orifice (14) which is conveniently sized so that the shaft (5) of the bolt (4) passes through said orifice, as shown in the breakdown in FIG. 1.

When the nut (7) is threaded on the shaft (5), the end (13) of the electrical component (12) is tightly gripped against the surface (9) of the holding element (8) and the latter, in turn, against the surface (15) of the base element (1). The pressure exerted by the nut (7) on the holding element (8) causes the toothed legs (11), which are arranged inside the respective peripheral housings (3) of the base element (1), to expand inside the latter, thus preventing axial movement of the bolt (4) thanks to the teeth of the legs (11), which may be observed in FIG. 1.

The inner geometry of the central housing (2) of the base element prevents the head (6) of the bolt from turning, as described above. Thus, the combination of said geometry of the housing (2) and the configuration of the holding element (8) prevents any movement of the bolt (4) and prevents it from leaving the housing (2) of the base element (1).

The materials of the elements which make up the device for fixing electrical components, as well as the shapes, dimensions and other accessory elements, may conveniently be replaced by other technically equivalent materials, shapes and dimensions, provided that they do not depart from the essential nature of the present invention, nor from the inventive concept of the same as defined in the claims included below.

What is claimed is:

1. A device for fixing electrical components, comprising:

a base element (1);

a bolt (4) having a head (6) joined to said base element (1);

a nut (7) threaded on the bolt (4);

an electrical component (12), and a holding element (8), wherein:

the electrical component (12) and the holding element (8) are radially restrained by the bolt (4) and positioned axially along the bolt (4) between the nut (7) and the base element (1), and when the nut (7) is threaded, said holding element (8) expands inside the base element (1) and axially secures the bolt (4) to the base element (1).

2. A device for fixing electrical components in accordance claim 1, wherein said bolt further comprises a shaft (5), and the head (6) is of a larger diameter than the shaft (5) and has a shaped perimeter that matches a shape of a central housing (2) of said base (1) so that when the bolt (4) is connected to the base (1), the interaction of the shaped perimeter and the central housing prevent rotation of said bolt (4).

3. A device for fixing electrical components in accordance with claim 1, wherein the holding element (8) comprises a surface (9) provided with a central orifice (10) inside which the bolt (4) passes, and a number of legs (11) which project from said surface (9) and which couple in corresponding housings (3) in the base element (1).

4. A device for fixing electrical components in accordance claim 3, wherein the holding element (8) comprises four legs (11) and the base element (1) consists of a housing (2) with complementary dimensions to those of the head (6) of the bolt (4) and four housings (3) for the insertion of said legs (11) of the holding element (8).

5. A device for fixing electrical components in accordance with claim 3, wherein said legs (11) of the holding element (8) include a series of teeth intended to fix the holding element (8) in the housings (3) of the base element (1).

6. A device for fixing electrical components in accordance with claim 5, wherein said teeth protrude in a direction substantially orthogonal to a predominant direction of extension of said legs (11).

7. A device for fixing electrical components, comprising:

a base element (1);

a bolt (4) having a head (6) joined to said base element (1);

a nut (7) threaded on the bolt (4);

an electrical component (12) and a holding element (8), wherein:

the electrical component (12) and the holding element (8) are radially restrained by the bolt (4) and positioned axially along the bolt (4) between the nut (7) and the base element (1), when the nut (7) is threaded, said holding element (8) expands inside the base element (1) and blocks the bolt (4) with respect to the base element (1)

the holding element (8) comprises a surface (9) provided with a central orifice (10) inside which the bolt (4) passes, and a number of legs (11) which project from said surface (9) and which couple in corresponding housings (3) in the base element (1), and the holding element (8) comprises four legs (11) and the base element (1) consists of a housing (2) with complementary dimensions to those of the head (6) of the bolt (4) and four housings (3) for the insertion of said legs (11) of the holding element (8).

* * * * *